United States Patent [19]

Dobson

[11] Patent Number: 4,666,129

[45] Date of Patent: May 19, 1987

[54] BARRIER

[75] Inventor: Donald J. Dobson, Glendale, Ariz.

[73] Assignee: American Fence Corporation, Phoenix, Ariz.

[21] Appl. No.: 693,738

[22] Filed: Jan. 23, 1985

[51] Int. Cl.[4] ..... E04H 17/04

[52] U.S. Cl. ..... 256/2; 256/8; 256/9

[58] Field of Search ..... 140/66, 58; 29/7.1; 256/1, 2, 3, 4, 5, 6, 7, 8, 9

[56] References Cited

U.S. PATENT DOCUMENTS

| | | | |
|---|---|---|---|
| 731,890 | 6/1903 | Green | 256/2 X |
| 2,908,484 | 10/1959 | Uhl | 256/8 |
| 3,155,374 | 11/1964 | Sieffert | 256/2 |
| 3,463,455 | 8/1969 | Mackel | 256/8 |
| 3,763,529 | 10/1973 | Musgrave | 140/58 X |
| 4,484,729 | 11/1984 | Maineiro et al. | 251/1 |
| 4,509,726 | 4/1985 | Boggs et al. | 256/8 |

FOREIGN PATENT DOCUMENTS

| | | | |
|---|---|---|---|
| 65395 | 6/1914 | Austria | 256/2 |

*Primary Examiner*—Cornelius J. Husar
*Assistant Examiner*—Joseph A. Fischetti
*Attorney, Agent, or Firm*—Cahill, Sutton & Thomas

[57] ABSTRACT

A metal tape barrier is constructed of straight sections of elongated tape having barbs formed at spaced intervals along the tape. The barrier has a triangular configuration in cross section with the sections of tape forming the legs of the triangle. Adjoining convolutions of the barrier are connected together at spaced points in such a manner that the tape sections assume accordian pleat-like configurations when the barrier is stretched lengthwise for installation. A second set of sections of tape may be added to the barrier and may have their ends connected to intermediate regions of the sections forming the legs of the triangle. This second set of tape sections are disposed to close off the inside of the main triangle of the barrier. Connections to end regions of the tape sections are made at the location of the barbs on the tape so that the barbs project beyond the connections. In one configuration the barrier has a cross section like an isosceles triangle.

20 Claims, 12 Drawing Figures

FIG. 1
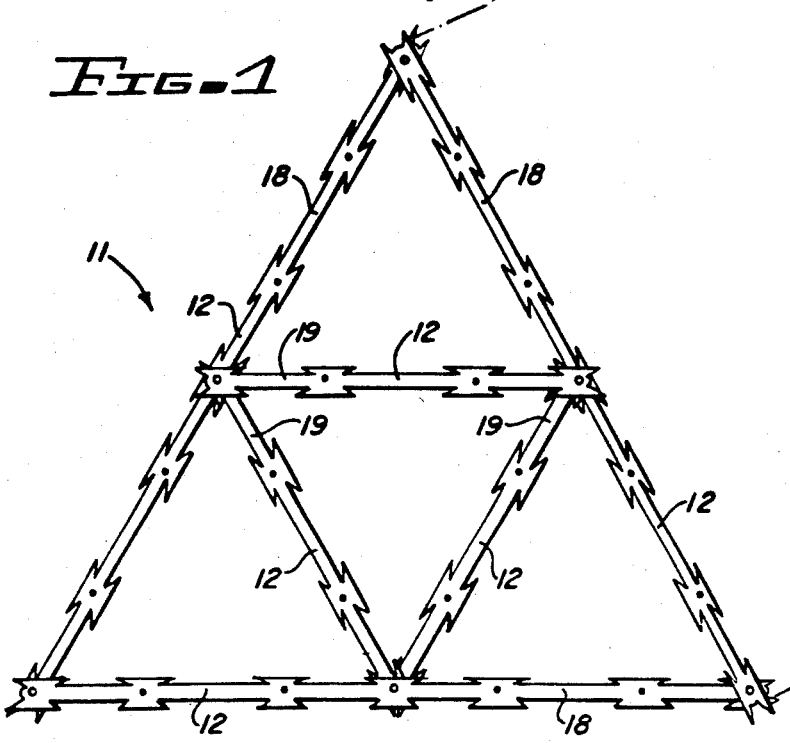
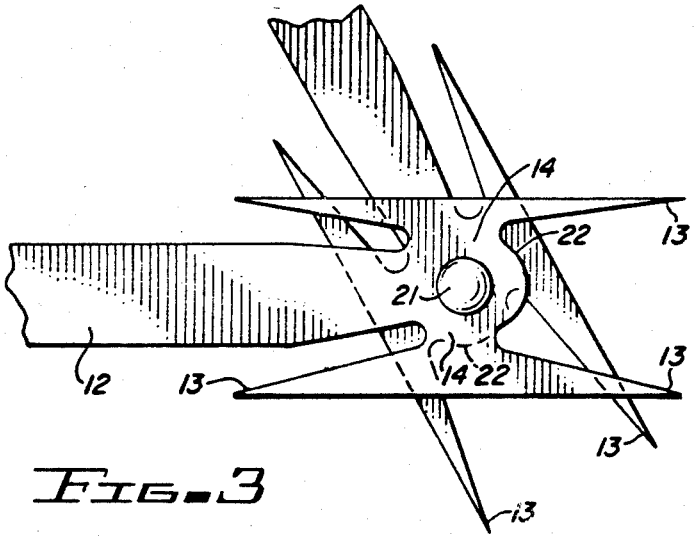
FIG. 3
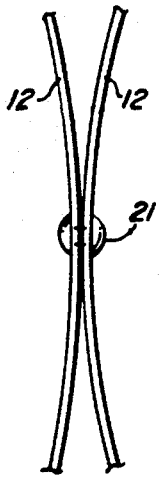
FIG. 4
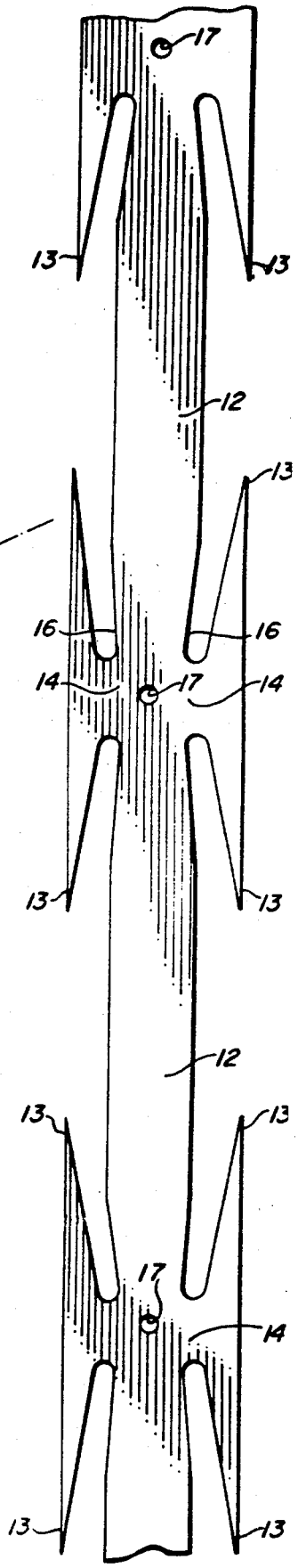
FIG. 2

FIG. 5
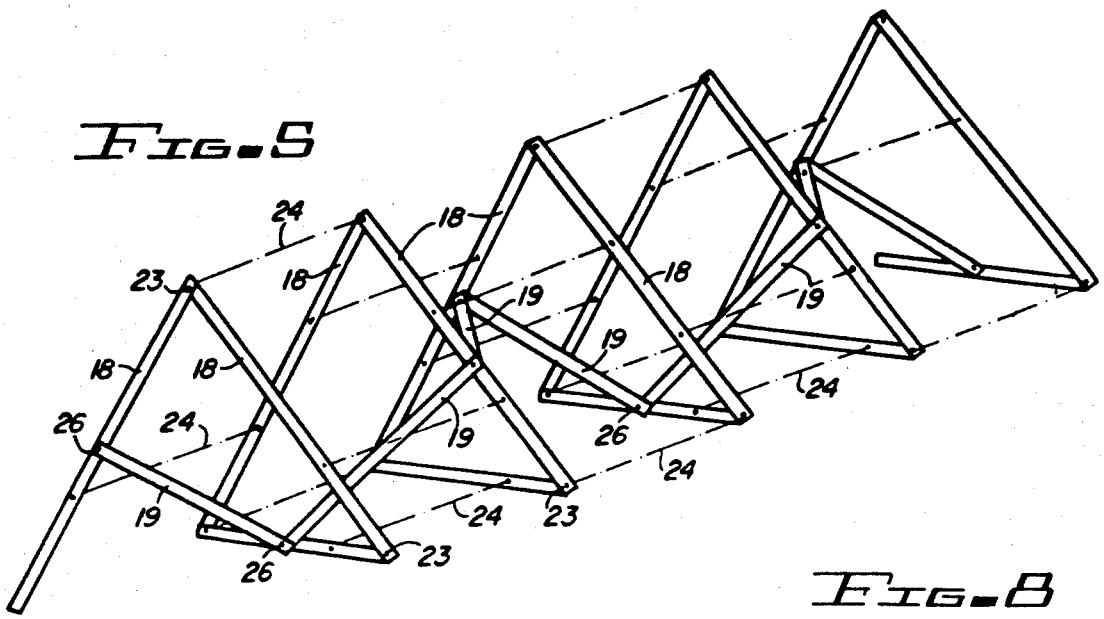
FIG. 8
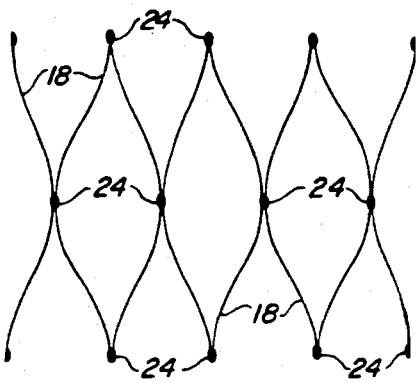
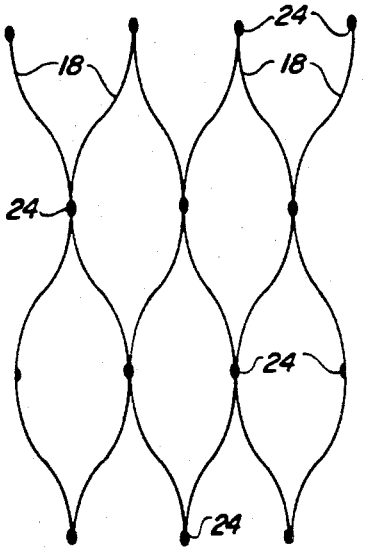
FIG. 6
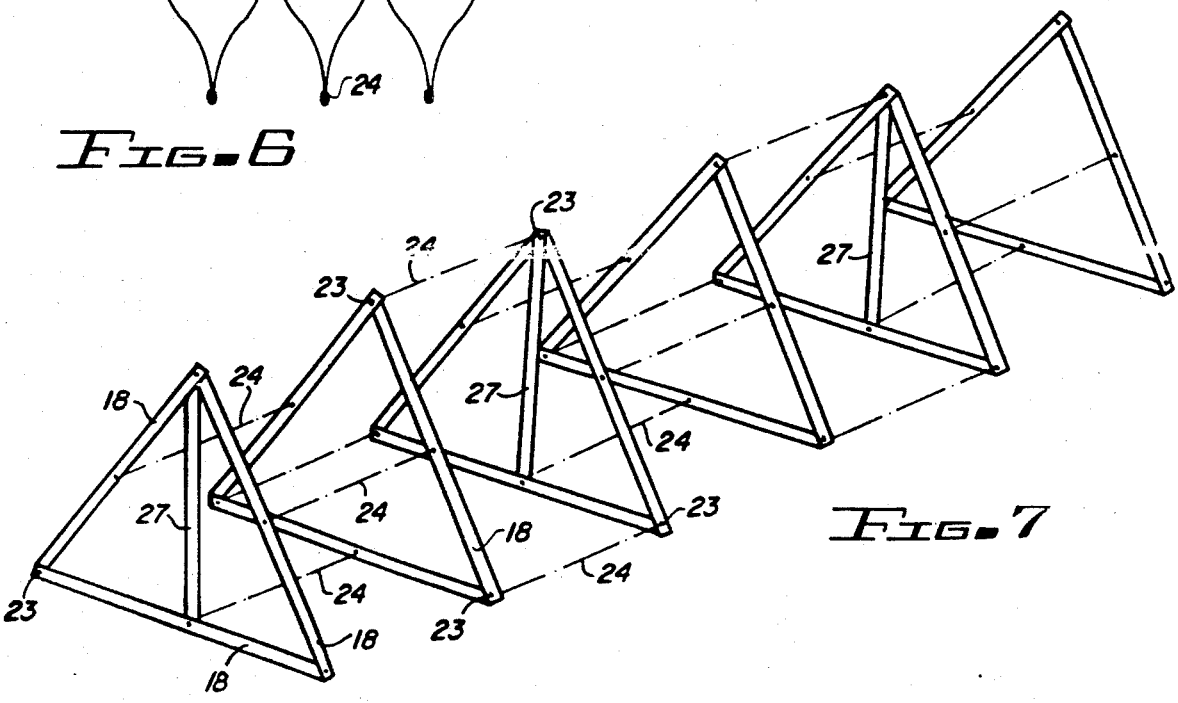
FIG. 7

BARRIER

TECHNICAL FIELD

This invention relates to security barriers of the type employed to prevent unauthorized entry or exit of people from secure facilities, such as armed forces installations, correctional institutions and commercial and industrial storage areas.

BACKGROUND ART

It has long been the practice to enhance physical security at various installations by providing barriers constructed of barbed entanglement devices. These barriers usually take the form of helical coils of barbed materials which are placed atop walls and fences or arranged in stacked arrays between walls and that fences. The oldest, and most common, form of barbed barrier is that made from barbed wire. Characteristically, barbed wire is only barely self-supporting and therefore can be crushed from a coil form with very little effort. Such barriers usually can be breached with simple aids such as a heavy cloth or a board. Moreover, the rather flimsy appearance of the barbed wire and the fairly short, non-lethal, barbs thereon, often fail to discourage a person from attempting to breach the barrier. It has thus been recongnized that for secure installations more rugged and more intimidating barriers are required. This has led to the development of barbed tape barriers.

There are two types of barbed tape in common use today. The first of these is usually referred to as "Barbed Tape Concertina" and is formed by clinching a strip of barbs over a high tensile, spring steel wire which is preformed to the desired helical configuration. This type of tape is disclosed in U.S. Pat. No. 2,908,48, granted Oct. 13, 1959 to S. Uhl for "BARBED WIRE SPIRAL" and U.S. Pat. No. 3,916,958, granted Nov. 4, 1975 to S. Uhl for "PROCESS AND APPARATUS FOR PRODUCING A BARBED SPIRAL". One disadvantage to this type of barbed tape is its cost, which is relatively high because of the requirement that spring quality steel be used for the supporting wire core of the tape. This tape is also deficient in its performance because the barrier convolutions are relatively weak in vertical compression. Even though it is the usual practice to clip together adjoining convolutions at spaced intervals to impart structural integrity to the barrier, simple breaching aids usually are sufficient to subvert the purpose of the barrier. Lastly, the short barbs usually provided on this type of tape and the "skinny" appearance of the tape render the tape only slightly more intimidating than ordinary barbed wire. Thus this tape fails to discourage attempts to breach it.

The other form of barbed tape in common use today is that known generally by its military designation of "General Purpose Barbed Tape Obstacle", or "GPBTO". This barrier consists of a unitary flat metal strip which is bent edge wise in the form of a helix and has portions cut away so that elongated barbs are provided at spaced intervals along the two edges of the strip. In some of these barriers the strip is formed with a continuous uniform arcuate curvature as disclosed in U.S. Pat. No. 3,463,455, granted Aug. 26, 1969 to P. T. Meckel for "HELICAL BARBED TAPE UNIT". Other barriers of this type are formed by edge bending the strip into identically angularly displaced adjoining linear segments to form the helix. Such a tape is disclosed in U.S. Pat. No. 4,040,603, granted Aug. 9, 1977 to M. R. Mainiero for "BARBED METAL TAPE". The method for manufacturing this tape is disclosed in U.S. Reissue Pat. No. 30,814, reissued Dec. 8, 1981 to M. R. Mainiero for "APPARATUS AND METHOD FOR FORMING BARBED TAPE". The Meckel patent and the Mainiero patents disclose techniques for providing shallow reinforcing channels or grooves throughout the linear extent of the tape strip, presumably for the purpose of rigidifying the resulting barrier. Not withstanding such reinforcement, barriers formed in the manner taught by Meckel and Mainiero are required to be fabricated from either expensive, spring quality, austenitic stainless steel materials or of lower quality steel in a thicker strip in order to possess sufficient strength to resist collapsing forces from breach attempts. Furthermore, in order to control bending of the strip of metal stock used to manufacture the Mainiero tape, it is usually necessary to punch holes in the tape at the bend locations and such holes further weaken the tape in edgewise bending.

One technique for reducing the breachability of the GPBTO barrier is to attach spacer wires between corresponding points on successive convolutions of the barrier. This is described in the aforementioned Meckel patent. Another technique that has been employed for this purpose is to fasten, weld together, or otherwise secure corresponding points on successive convolutions much in the same manner as has been done with Barbed Tape Concertina and described in the aforementioned Uhl patents. The attachment of spacer wires and the fastening or welding together of the convolutions of a helical barrier both present complex manufacturing problems which contribute greatly to the cost of the complex barriers.

Further efforts to improve the intimidation factor and to reduce the breachability of barbed tape barriers has resulted in a second helical tape being disposed inside the outer, or main helical tape. The aforementioned Meckel patent discloses a GPBTO barrier with this construction. U.S. Pat. No. 3,155,374, granted Nov. 3, 1964 to G. Sieffert for "PLAIN OR BARBED WIRE DEFENSE COIL", discloses a Barbed Tape Concertina with one helix inside another. Of course, with any dual helix barrier, means must be provided for supporting the inner helix on the outer helix and this means that additional cumbersom and costly wires, fasteners or welds must be incorporated into the barrier.

There continues to be a need for an effective barbed tape barrier which can provide all of the advantages of the Barbed Tape Concertina and the GPBTO barrier, but which can be efficiently and inexpensively manufactured and is rugged and intimidating in use.

DISCLOSURE OF INVENTION

The barrier of this invention is formed of elongated metal tape which has barbs formed at spaced intervals along the tape. However, unlike prior barbed tape barriers which invariably have been formed by winding a continuous length of tape into a continuous helix, the barrier provided by this invention if fabricated from a plurality of discrete, generally straight sections of tape.

Also, instead of providing a barrier of circular or oval cross sections as has been done previously, this invention provides a barrier that preferably has a triangular cross section with discreet tape sections forming the legs of the triangles. The triangular shape is inherently stable and strong and enables the barrier to resist collapse should someone attempt to breach the barrier.

One highly desirable feature of the prior art barriers has been retained. And that is the compact, longitudinally "collapsed" condition in which the barrier is shipped to its destination. The tape sections forming the convolutions of the barrier are arranged in face to face relationship with the faces disposed generally perpendicular to the longitudinal axis of the barrier. The collapsed barrier thus occupies a minumum amount of space and is easy to transport. During installation, the ends of the barrier are pulled apart, separating several convolutions of the barrier to impart the full operative length to the barrier. The tape sections forming adjoining convolutions of the barrier are connected together at locations spaced along the sections so that when the barrier is deployed, i.e. longitudinally lengthened, the tape sections take on accordian pleat-like configurations further increasing the strength of the barrier and enhancing its ability to resist breaching.

The set of tape sections forming the trian9ular body of the barrier can be assembled in either of two ways. In one assembly the sections are connected end to end to form a continuous helix of triangular sections. In the other assembly, individual triangles are formed from the sections and then the sections of one triangle are connected at spaced intervals to sections of adjoining triangles. Although the assembly procedure chosen will dictate the manufacturing equipment required, both procedures are capable of producing an equally effective barrier.

The barrier also preferably includes a second set of tape sections which are connected at their ends to intermediate regions of the tape sections forming the main triangular body of the barrier. This second set of tape sections forms, in essence, another triangular barrier within the main triangular body and significantly increases the density of the barrier.

In a further adaption of the invention,if a self-supporting barrier is not required, one face only of the barrier can be used as a barbed tape curtain strung between posts to form a fence.

BRIEF DESCRIPTION OF THE DRAWINGS

This invention is hereinafter described in greater detail by reference to the accompanying drawings wherein:

FIG. 1 is a partial, isometric view showing one end of a barrier constructed in accordance with this invention and in which the remainder of the barrier is shown in phantom;

Fig. 2 is an enlarged view of the face of a section of barbed tape from which the barrier is constructed;

FIG. 3 is an enlarged view of a portion of one of the barrier convolutions showing the preferred manner in which the ends of the tape sections are connected;

FIG. 4 is an enlarged view showing another form of connection utilized in the construction of the barrier;

FIG. 5 is an exploded perspective view diagramatically illustrating one assembly for the components of the barrier;

FIG. 6 is a diagramatic illustration of a portion of one face of a barrier assembled as shown in FIG. 5;

FIG. 7 is an exploded perspective view diagramatically illustrating another assembly for the components of the barrier;

FIG. 8 is a diagramatic view of a portion of one face of a barrier constructed in the manner shown in FIG. 7.

BEST MODES FOR CARRYING OUT THE INVENTION

Figure 9:
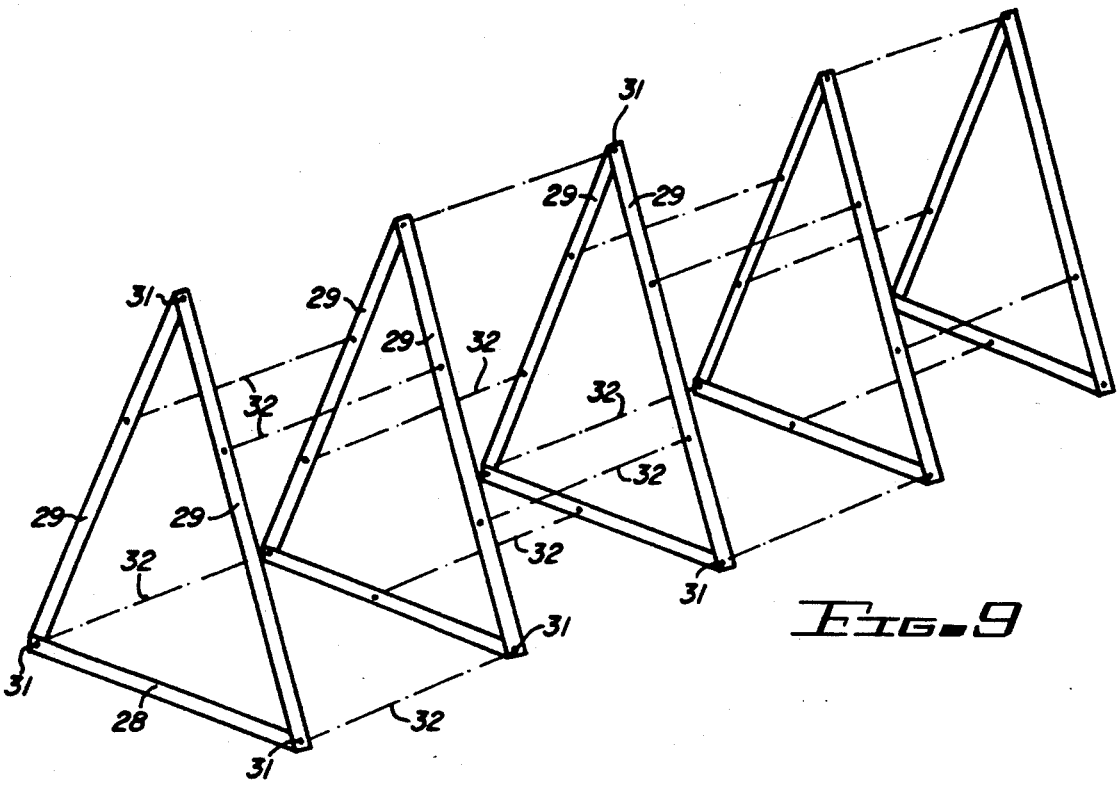
FIG. 9 is an exploded perspective view diagramatically illustrating yet another assembly for the components of the barrier.

The barbed tape barrier illustrated in FIG. 1 and designated generally by reference numeral 11 is constructed of discreet sections of elongated, substantially flat barbed tape 12, an enlargement of which is shown in FIG. 2. Tape 12 is formed of a flat strip of corrosion resistant sheet metal, such as stainless steel and for a typical barrier will have a thickness of approximately 0.635 mm (0.025 in) and a width of approximately 2.5 cm (1 in.). The tape is formed, as by stamping, to provide a plurality of barbs 13 thereon. The barbs 13 preferably appear as spaced clusters of four barbs with a pair on one edge of the tape directly opposite another pair on the other edge. It can be appreciated, however, that tape 12 may, if desired, be provided with barbs only along one edge instead of both of the edges, or the barbs along one edge can be staggered with respect to the barbs on the other edge. The barbs 13 are preferably joined to the remainder of tape 12 by means of root portions 14 connected to the shanks of oppositely, longitudinally extending barb pairs. The width of tape 12 in the vicinity of barb portions 14 may be reduced as indicated at 16 to further enhance the penetrating capability of barbs 13. The tape 12 may also have a series of holes 17 punched therein in the vicinity of the root portions 14 of the barbs 13 to facilitate fabrication of the barrier 11 therefrom.

Referring again to FIG. 1, the barrier 11 preferably is constructed of two sets of discreet lengths of the barbed tape 12. The first set, consisting of sections designated by reference numeral 18, form the legs of the main triangular body of the barrier. The second set of sections, designated 19, have their ends connected to intermediate regions of the tape sections 18 and form another triangular portion of the barrier within the main triangular portion formed by tape sections 18. FIG. 3 illustrates the preferred manner of connecting an end of one of the sections of tape 12 to another tape. The connection there illustrated is made by a rivet 21 passing through openings 17 in the tapes 12 in the vicinity of root portions 14 of barbs 13. Each tape 12 has been cut off so that it terminates at 22, leaving a pair of barbs 13 projecting in an exposed manner beyond the connections between the tapes and beyond the ends of the tapes themselves. This arrangement insures maximum utilization of the barbs 13 on the tape 12 for enhancing the intimidation capabilities of the barrier. A similar connection is preferably employed where the ends of tape sections 19 are connected to intermediate regions of tape sections 18, so that the barbs at the ends of section 19 project outwardly and beyond section 18.

FIG. 4 illustrates how another connection can be made between adjoining barbed tapes 12. This connection also employs a rivet 21. It should be understood, however, that other connecting means such as staples, clamps or welds, can be employed.

One assembly pattern for fabricating the barrier 11 is illustrated in FIG. 5. As there shown, the first set of barbed tape sections 18 are connected end to end at points 23 in a manner to form a helical structure having a triangular cross section. In addition, at spaced points along the length of the resulting triangular helix, connections are provided between adjoining convolutions of the helix. These additional connections are depicted by the dot and dash lines 24 in FIG. 5 and may be of the type shown in FIG. 4. FIG. 5, of course, is diagramatic in that the spacings between the convolutions of the helix are greatly exaggerated for clarity of illustration. Normally, when the barrier 11 is initially constructed the tape sections 18 will reside in close face to face relationship with very little space in between so that the barrier occupies a minimum amount of space.

The spacing of connections 24 between adjoining convolutions of the barrier helix is 2/9ths of the distance around one complete convolution. In other words, if you follow a path along sections 18 of the helix you will encounter a connection between a section and a subsequent section in an adjoining convolution each time you have traversed a distance equal to 2/9ths of the total distance around one convolution. This connection system results in the tape sections 18 assuming the accordian pleat-like configuration shown in FIG. 6 when the ends of the barrier are pulled apart to deploy the barrier. Other spacings of the connections 24 can be employed when the sections of barbed tape are connected in helical fashion. For example, a spacing of 2/5ths of the distance around one convolution will also produce satisfactory results. And, as mentioned previously, these connections can be made by means of rivets 21, or by other means such as welding, stapling or clamping.

The tape sections 19 of the second set have their ends connected at 26 to intermediate regions of the tape sections 18 of the first set as shown in FIG. 5. Sections 19 are progressively oriented to produce a triangular configuration within the confines of the main triangular body formed by the first set of sections 18.

The benefits derived from addition of the second set of tape sections are two fold. In the first place, the barbed tape sections 19 within the barriers interrupt the open space in the barrier and discourage attempts to breach the barrier by crawling longitudinally through the barrier.

Secondly, the internal structure provided by the second set of tapes 19 greatly strengthens the barrier against being collapsed vertically.

FIG. 7 illustrates an alternative mode of carrying out the invention in which a different assembly pattern is followed in joining the sections of barbed tape 12. As there shown, the first set of barbed tapes 18 have their ends connected at 23 to form a series of discrete triangles, or triangular convolutions. Connections 24, again depicted by dot and dash lines, are then employed to join spaced regions on adjoining triangular sections 18. In the pattern of connections 24 progressing from left to right in FIG. 7, connections 24 join middle regions of tape sections 18 of the first two triangles, end regions of the second and third triangles, again mid regions of the third and fourth triangles and so on. This produces an accordian pleat-like configuration for the sections 18 like that shown in FIG. 8 when the barrier is deployed. Other spacings and greater numbers of connections 24 can of course be employed.

It should again be noted that FIG. 7 is an exploded and exaggerated diagramatic representation of the barrier. When initially manufactured, the triangles formed by the first set of tape sections 18 will be in close face to face relationship to occupy a minimum amount of space.

In the barrier construction of FIG. 7 a second set of tape sections 27 are utilized to interrupt the open central region of the barrier. In the embodiment illustrated the tapes 27 are disposed vertically in alternate triangles formed by tapes 18 and have their upper ends connected at the apex of the barrier by connections 23 and their lower ends joined to intermediate regions of lower section tapes 18 by connections 24.

Figure 10:
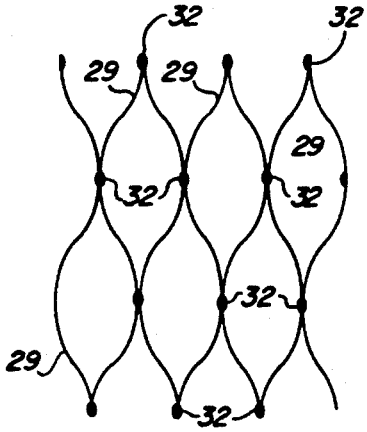
FIG. 10 is a diagramatic view of a portion of one face of a barrier constructed in the manner shown in FIG. 9.
Figure 11:
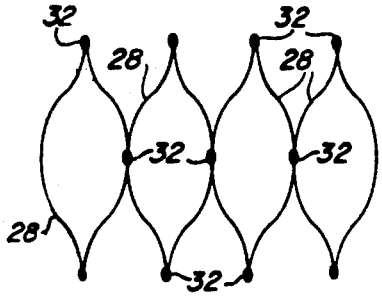
FIG. 11 is a diagramtic view of a portion of the base of a barrier constructed in the manner shown in FIG. 9.

A further mode for carrying out the invention is illustrated in FIGS. 9 through 12. In this embodiment of the invention the cross section of the barrier is that of an isosceles traingle formed by short barbed tape sections 28, which form the base of the triangle and the base of the barrier, and two longer, equal length tape sections 29 which form the sides, or faces, of the triangle and the barrier. The assembly pattern for this barrier is shown diagramatically in FIG. 9. Each tape section 28 is joined to two of the longer tape sections 29 at their respective ends by means of connections 31. The discrete triangles, or triangular convolutions, thereby formed are in turn interconnected by means of connections 32, depicted by dot and dash lines. In the pattern of connections 32 progressing from left to right in FIG. 9, connections 32 join the first and second triangles at both ends of base tape sections 28 and intermediate regions of the side leg tape sections 29 approximately two thirds of the way up from the bottom of these sections. The second and third triangular assemblies are joined by connections 32 connecting intermediate regions of their base sections 28, at approximately mid length of these sections, and the connections 32 also join intermediate adjoining regions of the side sections 29 approximately one third of the way up from their lower ends and connect these sections again at their apex, or uppermost ends. This pattern of connections is repeated connecting the third and fourth triangular sections and then the fourth and fifth triangular sections, and so on until a barrier of desired length is formed. The pattern of connections 32 just described produces an accordian pleat-like configuration for the barrier like that shown in FIGS. 10 and 11 when the barrier is deployed. FIG. 10 illustrates the accordian pleat-like configuration assumed by the side tape sections 29 of the triangular barrier and FIG. 11 illustrates the accordian pleat-like configuration assumed by the lower, or base, tape sections 8.

Although not shown, it should be apparent that the configuration illustrated in FIGS. 9 through 11 could well be equipped with a second set of tape sections similar to those illustrated in FIG. 5 or FIG. 7.

Constructing the barrier of this invention with a cross section resembling an isosceles triangle, as shown in FIG. 9, effects savings in the quantity of barbed tape 12 required for the barrier. In any barrier which has a portion thereof facing or in contact with the ground or other surfaces on which the barrier is erected, that portion of the barrier is less intimidating and less effective than exposed side and upper faces or regions of the barrier. Shortening the lower leg tape sections 28 for the isosceles triangular barrier reduces this less effective portion of the barrier without materially affecting the overall performance of the barrier and permits more tape material to be incorporated into the side tape sections 29 to increase the height and effectiveness of the barrier.

Figure 12:
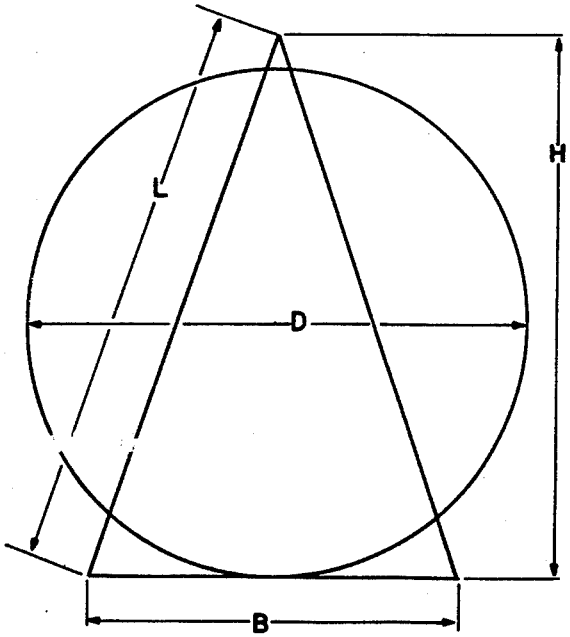
FIG. 12 is a diagramatic view comparing a barrier constructed in accordance with this invention with a helical barrier of the prior art.

The savings in the amount of material required for the isosceles triangular barrier as compared to a conventional helical circular barrier is illustrated in FIG. 12. The circular cross section of the helical barrier is depicted in this figure by a circle having a diameter of D. The isosceles triangular barrier can be constructed to a height H greater than the diameter D of the circular barrier from side tape sections having a length L and a base leg tape section having a length B, approximately one half the length of the side leg sections. A helical barrier having a diameter D equal to 32 inches will require 100.5 linear inches of tape material for each convolution of the barrier. An isosceles triangular barrier having a height of 34 inches, actually taller than the helical barrier, can be constructed of side, or face, tape sections having a length L of 36 inches and a base leg section having a length B of 24 inches, which gives a total linear length of the perimeter of the triangular barrier of only 94 inches. Even allowing for a couple of inches of tape to permit the sections of the triangular barrier to be overlapped and joined less tape is required for each convolution of this barrier than is required for the helical barrier.

Of course, a barrier constructed with the assembly pattern illustrated in FIGS. 5 and 6 and described above can have an isosceles triangular configuration imparted thereto to achieve the benefits of that configuration.

It can be appreciated that a barrier 11 constructed in accordance with the principles discussed herein will possess considerable strength, even though manufactured from light gauge tape 12. The triangular configuration of the barrier contributes markedly to this strength as does the interconnection and accordian pleating of the tape sections 18 which occurs when the barrier is deployed. The barrier thus is particularly capable of resisting collapse from downwardly applied forces as might be generated by a plank being placed across the barrier by someone attempting to breach the barrier.

A further application of the principles of this invention lies in the fabrication of a non-self-supporting fence, or curtain, structure. It should be apparent that the tape sections constituting one face only, for example, the tape configurations illustrated in either FIGS. 6, 8 or 10, can be utilized as a barbed curtain and strung between posts to form a fence-like barrier. Such a curtain would be compact for shipment, but extensible into accordian pleat-like barbed sections when elongated for installation.

The barrier of this invention also has that highly desirable quality of giving the appearance of substance and strength and of presenting for clear view numerous ominous and intimidating barbs having the apparent capability of inflicting serious wounds to a person attempting to breach the barrier. The barrier is intimidating and therefore has the capability of discouraging someone from even attempting to breach it.

In addition to providing a barrier which is particularly effective for its intended use, this invention also provides a barrier which is susceptible of being manufactured inexpensively on highly automated equipment. Although some attempts have been made to automate the manufacture of Barbed Tape Concertina as suggested in the '958 Uhl patent mentioned above, the steps of attaching wires to or welding adjoining convolutions of barbed tape like that shown in the Meckel patent have generally been laborious manual operations. Usually, a complete helical barrier is formed, the turns are separated and the barrier is suspended on a rack so that appropriate fastenings can be made. The fastening operation is usually separate and apart from the helix forming operation and is both awkward and expensive.

By way of contrast, the barrier structure of the present invention is fabricated from a series of simple straight sections 18 and 19 which can be progressively, or serially, assembled and all connections thereto formed as the pieces are being brought together. Such an operation is particularly adapted to being automated.

What is claimed is:

1. A barrier stucture of triangular cross section comprising a plurality of generally straight sections of elonggated metal tape having barbs formed at spaced intervals along the tape, said tape sections being connected to one another generally at their ends with each tape section constituting a leg of the triangular cross section, and means connecting a region of each said tape section intermediate its ends to an adjacent tape section intermediate its ends whereby the tape sections assume an accordian pleat-like configuration when the barrier structure is elongated.

2. The barrier structure of claim 1 wherein the cross section thereof is a triangle having a base leg which is shorter than the side legs.

3. The barrier structure of claim 1 wherein adjacent tape sections are in face to face relationship and present their longitudinal edges outwardly and inwardly, respectively, of the triangular barrier structure.

4. The barrier structure of claim 3 wherein said barbs are formed on said longitudinal edges of the tape sections.

5. The barrier structure of claim 4 wherein the barbs on the tape sections are presented in opposite, longitudinally-extending pairs having an intermediate root portion connecting the barb pair to the tape and the connections at the ends of the tape sections are made in the vicinity of barb root portions whereby barbs project beyond the connected ends of the tape sections.

6. The barrier structure of claim 1 wherein the tape sections there recited constitute a first set of sections and the barrier structure further includes a second set of tape sections connected at their ends to regions of the tape sections of said first set.

7. The barrier structure of claim 6 wherein in the barbs on said second set of tape sections are presented in opposite longitudinally-extending pairs having an intermediate root portion connecting the barb pair to the tape, and the connections to the ends of the second set of tape sections are made in the vicinity of barb root portions whereby barbs project beyond the connected ends of the second set of tape sections.

8. The barrier structure of claim 6 wherein the tape sections of the second set form a triangular barrier structure inside the triangular barrier structure formed by said first set of tape sections.

9. A barrier structure comprising a plurality of generally straight sections of elongated metal tape having barbs formed at spaced intervals along the tape, said sections being connected one to the other at their ends and forming a helix of triangular cross section with each tape section constituting a leg of the triangular cross section.

10. The barrier structure of Claim 9 wherein the helix possesses a plurality of convolutions and means are provided for connecting adjoining convolutions at spaced intervals along the length of the helix.

11. The barrier structure of Claim 10 wherein the cross section thereof is a triangle having a base leg which is shorter than the side legs.

12. The barrier structure of Claim 10 wherein said connecting means are positioned at locations spaced along the helix at distances equal to two-ninths of the length of one convolution of the helix.

13. The barrier structure of Claim 9 wherein the tape sections there recited constitute a first set of sections and the barrier structure further includes a second set of tape sections connected at their ends to regions of the tape sections of said first set.

14. The barrier structure of Claim 13 wherein the barbs on said second set of tape sections are present in opposite longitudinally-extending pairs having an intermediate root portion connecting the barb pair to the tape, and the connections to the ends of the second set of tape sections are made in the vicinity of barb root portions whereby barbs project beyond the connected ends of the second set of tape sections.

15. The barrier structure of Claim 13 wherein the tape sections of the second set form a triangular barrier structure inside the triangular barrier structure formed by the first set of tape sections.

16. A barrier structure comprising a plurality of triangular convolutions disposed in face to face relationship, each triangular convolution being formed of generally straight sections of elongated metal tape having barbs formed at spaced intervals along the tape, said tape sections being connected at their ends to form a base leg and two side legs of each convolution, and means connecting spaced apart regions of each leg of each convolution to a like leg of an adjoining convolution whereby the legs of the convolutions assume an accordian pleat-like configuration when the convolutions are separated to elongate and deploy the barrier.

17. The barrier structure of claim 16 wherein the base of each convolution is shorter than the side legs thereof.

18. The barrier structure of claim 16 wherein the tape sections there recited constitute a first set of sections and the barrier structure further includes a second set of tape sections connected at their ends to regions of the legs of at least some of the convolutions.

19. The barrier structure of claim 18 wherein the tape sections of said second set have their ends connected to intermediate regions of the legs of the convolutions.

20. The barrier structure of claim 18 wherein the tape sections of said second set have their ends connected, respectively, to a connection between two legs of the convolution and to an intermediate region of the other leg of the convolution.

* * * * *